US005191309A

United States Patent [19]

Laros

[11] Patent Number: 5,191,309

[45] Date of Patent: Mar. 2, 1993

[54] ROTARY TRANSFORMER

[75] Inventor: Petrus C. J. Laros, Tilburg, Netherlands

[73] Assignee: U.S. Philips Corporation, New York, N.Y.

[21] Appl. No.: 749,801

[22] Filed: Aug. 26, 1991

[30] Foreign Application Priority Data

Sep. 6, 1990 [NL] Netherlands ..... 9001965

[51] Int. Cl.[5] ..... H01F 19/00

[52] U.S. Cl. ..... 336/120; 310/254; 310/261

[58] Field of Search ..... 310/254, 255, 259, 216, 310/261, 262, 264, 265, 267; 336/117, 119, 120, 135

[56] References Cited

FOREIGN PATENT DOCUMENTS 59-151408 12/1984 Japan ..... 336/120
61-164210 12/1986 Japan ..... 336/120
63-67711 3/1988 Japan ..... 336/120

*Primary Examiner*—Thomas J. Kozma
*Attorney, Agent, or Firm*—Brian J. Wieghaus

[57] ABSTRACT

The rotary transformer (1) has an inner core portion (3) which is enclosed by an outer core portion (5). The core portions (3, 5) are formed as hollow bodies of revolution of a ferromagnetic material which are rotatable with respect to one another about a common axis (9) and wherebetween an air gap (7) is present. The facing surfaces (11, 13) of the core portions (3, 5) are constructed as double conical surfaces whose bases (23, 25) face one another. In the conical surfaces (11, 13) there are provided first recesses (15) which are shaped as a staircase with substantially flat steps (19) on which transformer windings (21) are provided. The first recesses (15) in the inner core portion (3) are situated opposite first recesses (15) in the outer core portion (5), thus forming a winding chamber (17), windings (21) on the first core portion (3) cooperating with oppositely situated windings (21) on the outer core portion (5). The outer core portion (5) consists of at least two parts.

8 Claims, 2 Drawing Sheets

ROTARY TRANSFORMER

BACKGROUND OF THE INVENTION

The invention relates to a rotary transformer, comprising an inner core portion which is enclosed by an outer core portion, which core portions are formed as hollow bodies of revolution of a ferro-magnetic material which are rotatable with respect to one another about a common axis, their facing surfaces being constructed as conical surfaces provided with first recesses which are shaped as a staircase with substantially flat steps on which transformer windings are provided, the windings on the inner core portion and the outer core portion being situated opposite one another and cooperating in a two-by-two fashion, the windings on at least the outer core portion being constructed as self-supporting coils.

A transformer of this kind is known from the abstract in English of JP-A 59-151,408. The new types of scanners used in a video recorder require a rotary signal transfer device (RSO) comprising a large number of channels. If the known transformer were to be used for this purpose, the dimensions thereof would become rather large whereas the space available to the rotary signal transfer device is limited.

SUMMARY OF THE INVENTION

It is an object of the invention to provide a rotary transformer of the kind set forth in which a large number of channels is combined with a rotary signal transfer device having a compact construction.

To achieve this, the rotary transformer in accordance with the invention is characterized in that the facing surfaces of the core portions are constructed as double conical surfaces whose bases face one another, the outer core portion comprising at least two parts.

Because the rotary signal transfer device is constructed so as to be double conical, double the number of channels are available for the same diameter of the base of the conical surface as that of a single-conical rotary signal transfer device. When the bases of the conical surfaces face one another, as in the embodiment in accordance with the invention, the outer core portion must consist of at least two parts in order to enable mounting of the rotary signal transfer device.

A preferred embodiment of the rotary transformer in accordance with the invention is characterized in that the outer core portion is separated into two parts at the area of the bases of the two conical surfaces.

The outer core portion is formed by an upper and a lower hollow cone whose bases are arranged so as to contact one another and which can be readily fitted around the inner core portion.

A further preferred embodiment of the rotary transformer in accordance with the invention is characterized in that the two separated parts are interconnected by way of an annular spacer.

Because of the presence of a spacer between the upper and the lower outer core portion, the air gap between the inner and the outer core portion is adjustable by chosing of the thickness of the spacer.

Another preferred embodiment of the rotary transformer in accordance with the invention is characterized in that the annular spacer is made of an electrically conductive material. Because the spacer is made of an electrically conductive material, it can be used at the same time as a short-circuit winding, thus improving channel isolation.

A preferred embodiment of the rotary transformer in accordance with the invention is characterized in that each first recess in the conical surface of the outer portion changes over, at a side facing the base of the conical surface, into a second recess having a wall in the form of a cylindrical surface whose diameter is at least equal to the diameter of the surface of the outer core portion, facing the inner core portion, at the area of the transition between the first and the second recess.

Another preferred embodiment of the rotary transformer in accordance with the invention is characterized in that each first recess in the conical surface of the inner core portion changes over, at a side which is remote from the base, into a second recess having a wall in the form of a cylindrical surface whose diameter is at least equal to the diameter of the surface of the inner core portion, facing the outer core portion, at the area of the transition between the first and the second recess. Said steps enable both core portions to be provided with self-supporting coils. For the outer core portion, the winding of the transformer can be realized exclusively in this manner. This method is not necessary for the inner core portion, but it is comparatively simple and saves time.

A further preferred embodiment of the rotary transformer in accordance with the invention is characterized in that at the side of the first recess which faces the base of the conical surface the inner core portion is provided with a projection which projects into the second recess of the outer core portion and which has a wall in the form of a cylindrical surface parallel to the wall of the second recess.

A further preferred embodiment of the rotary transformer in accordance with the invention is characterized in that at the side of the first recess which is remote from the base of the conical surface the outer core portion is provided with a projection which projects into the second recess of the inner core portion and which has a wall in the form of a cylindrical surface parallel to the wall of the second recess.

The advantage of the above embodiments consists in that less air is present between the two core portions in the vicinity of the first recesses. Because the second recesses are provided in the two core portions, the air gap in the vicinity of the recesses is rather large. The air gap at those areas can be filled by means of ferrite, so that a uniform air gap is obtained. The flux flow will thus be improved.

The invention will be described in detail hereinafter with reference to the drawing.

DESCRIPTION OF THE PREFERRED EMBODIMENTS

Figure 1:
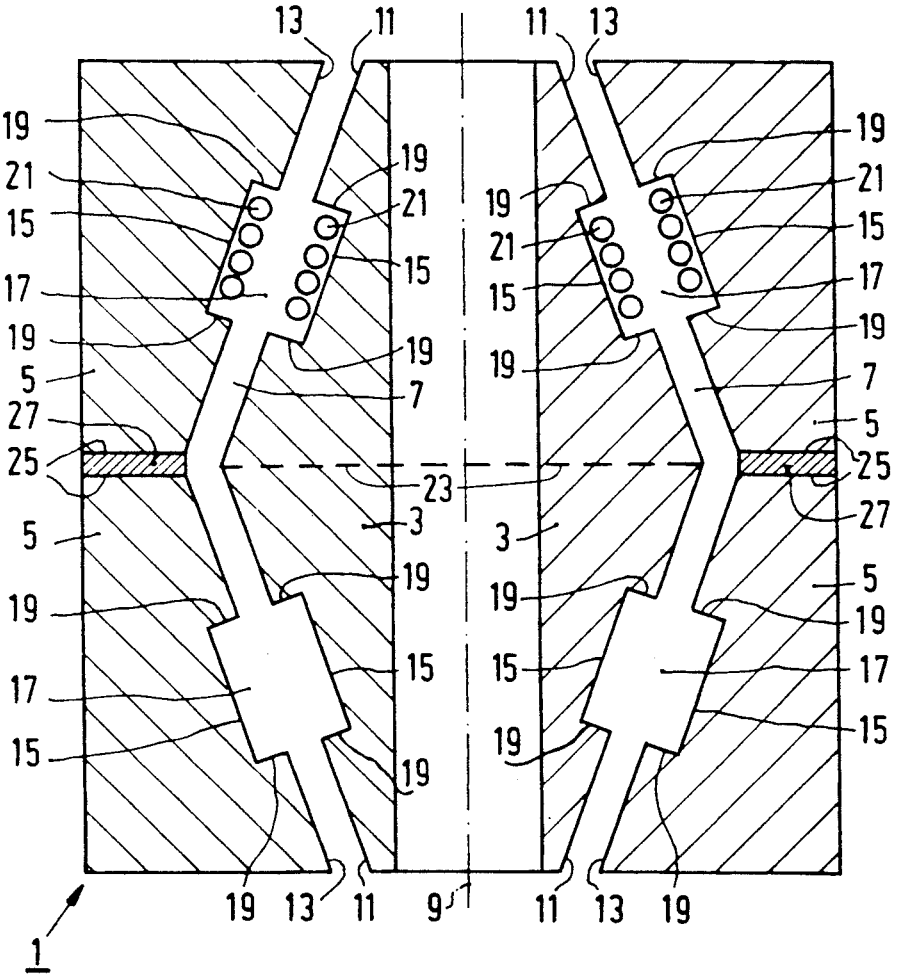
FIG. 1 is a longitudinal sectional view illustrating the principle of a rotary transformer in accordance with the invention.

The rotary transformer 1 shown in FIG. 1 comprises an inner core portion 3 which is enclosed by an outer core portion 5. An air gap 7 is present between the two core portions 3, 5. The core portions 3, 5 are constructed as hollow members of revolution which are rotatable with respect to one another about a common axis 9 and are made of a ferromagnetic material, for example ferrite.

The facing surfaces 11, 13 of the core portions 3, 5 are constructed as double conical surfaces with first recesses 15 which constitute a winding chamber 17. The recesses 15 have a staircase-shape with substantially flat steps 19 on which transformer windings 21 can be provided so that cooperating windings 21 of the inner core portion 3 and the outer core portion 5 are situated opposite one another.

FIG. 1 merely illustrates the principle of the rotary transformer 1. Transformer windings 21 are shown in only one of the winding chambers 17. Practical embodiments will be described in detail hereinafter with reference to the FIGS. 2 and 3. The bases 23, 25 of the conical surfaces 11, 13 face one another. The base 23 of the inner core portion 3 is denoted by a broken line for the sake of clarity. The outer core portion 5, however, comprises at least two parts. Separation is required in order to enable mounting of the transformer 1. In the embodiment shown, the separation is made at the area of the bases 25 of the conical surfaces 13. Between the two halves of the outer core portion 5 there is provided an annular spacer 27 which is made of an electrically conductive material. This material may be, for example, copper, the ring consisting of one or more layers of copper. This is because the air gap 7 between the inner core portion 3 and the outer core portion 5 can be adjusted by adaptation of the thickness of the ring 27. Moreover, the ring 27 of an electrically conductive material can also serve as a short-circuit winding. This short-circuit winding constitutes in a known manner an electrical isolation between the windings 21 present in the winding chambers 17 situated to both sides of the ring 27.

Figure 2:
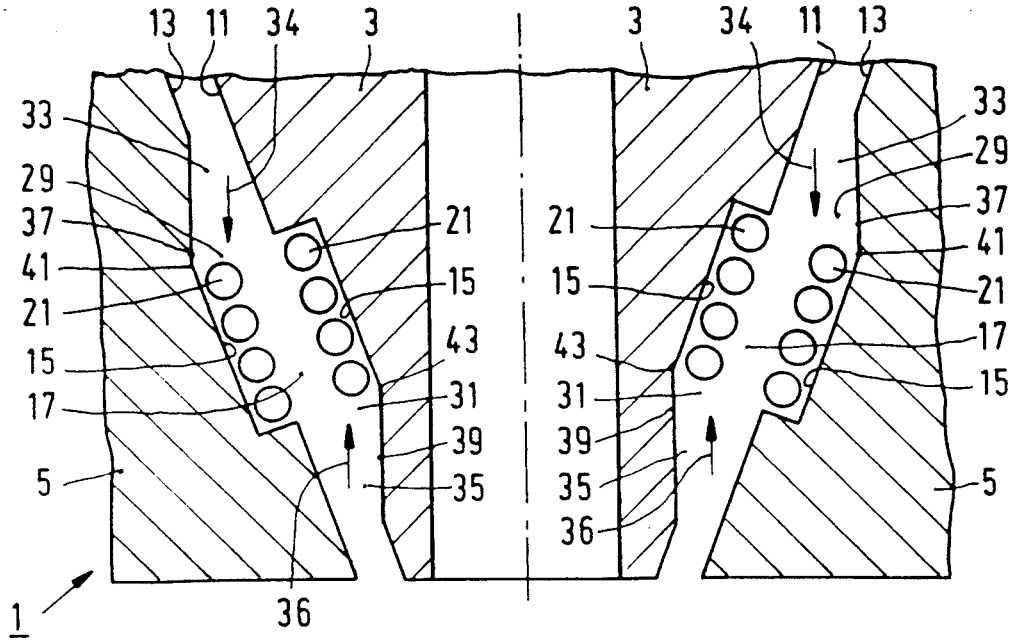
FIG. 2 is a detailed view of a part of a first embodiment of the rotary transformer proposed in FIG. 1.

FIG. 2 is a detailed view of a part of a practical embodiment of the transformer shown in FIG. 1.

Each first recess 15 in the conical surface 13 of the outer core portion 15 along the side 29 facing the base 25 changes over or merges, into a second recess 33. Each first recess 15 in the conical surface 11 of the inner core portion 3 along the side 31 remote from the base 23 changes over into a second recess 35. The walls 37, 39 of these two recesses 33, 35 are shaped as a cylindrical surface. For the outer core portion 5 the diameter of the cylindrical surface 37 is at least equal to the diameter of the inner surface 13 of the outer core portion 5, facing the inner core portion 3, at the area of the transition 41 between the recesses 15, 33. For the inner core portion 3, the diameter of the cylindrical surface 39 is at least equal to the diameter of the surface 11 of the inner core portion 3, facing the outer core portion 5, at the area of the transition 43 between the two recesses 15, 35. The second recesses 33 in the outer core portion 5 serve to make the winding chamber 17 accessible to the windings 21. The windings 21 are preferably constructed as self-supporting coils. These coils are guided, via the second recesses 33 in the outer core portion 5, into the first recesses 15 according to the arrows 34. The second recesses 35 in the inner core portion 3 simplify the manufacture of the transformer 1 because self-supporting coils can thus be used for both core portions 3, 5. The coils are introduced into the first recesses 15 of the inner core portion 3 in the direction of the arrows 36 in the same way as for the outer core portion 5.

Figure 3:
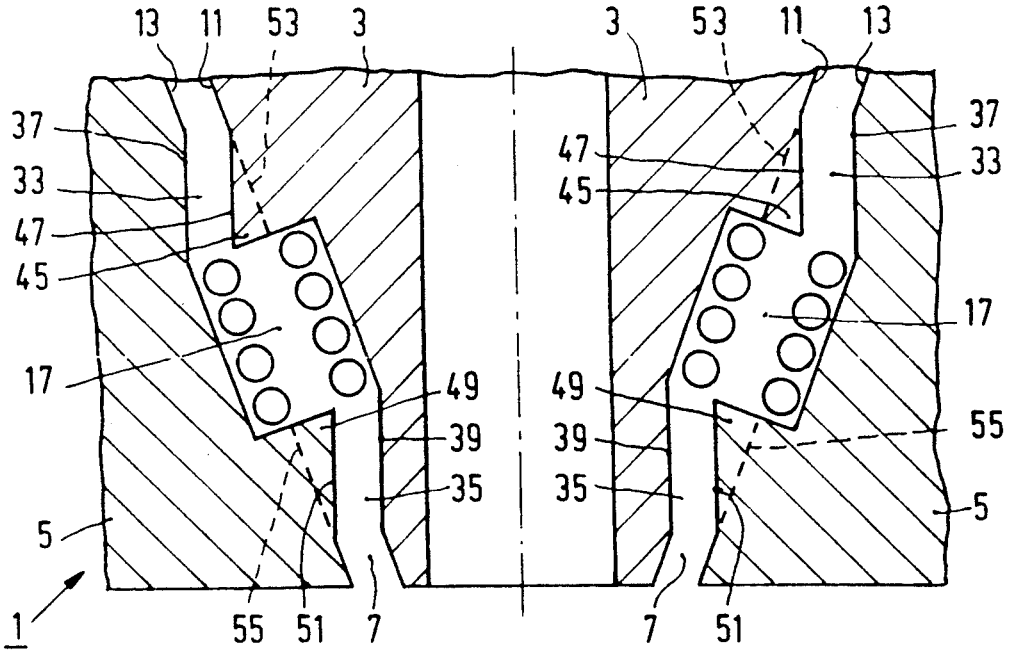
FIG. 3 is a detailed view of a part of a second embodiment of the rotary transformer proposed in FIG. 1.

FIG. 3 shows another practical embodiment of the rotary transformer 1.

Opposite each second recess 33 in the outer core portion 5 the inner core portion 3 comprises a projecting portion 45 whose wall 47 is shaped as a cylindrical surface which is parallel to the cylindrical surface 37 of the second recess 33 in the outer core portion 5. Opposite each second recess 35 in the inner core portion 3 the outer core portion 5 comprises a projecting portion 49 whose wall 51 is shaped as a cylindrical surface which is parallel to the cylindrical surface 39 of the second recess 35 in the inner core portion 3. The projecting portions 47, 49 on the inner core portion 3 and the outer core portion 5 are formed of the same ferromagnetic material. For the sake of clarity, the projecting portions 47, 49 are denoted by broken lines 53, 55 in FIG. 3. Thus, the air gap 7 is substantially reduced in the vicinity of the winding chamber 17, so that it has approximately the same width outside the winding chamber 17. As a result, the flux flow will be more attractive than in the embodiment shown in FIG. 2. The principle illustrated in FIG. 1 involves only two pairs of oppositely situated, cooperating windings 21, only one pair being shown. In reality the rotary transformer 1 comprises a series of winding chambers 17 with pairs of transformer windings 21.

I claim:

1. A rotary transformer, comprising an inner core portion and an outer core portion enclosing the inner core portion, the core portions being hollow bodies of revolution of a ferromagnetic material which are rotatable with respect to one another about a common axis, the inner and outer core portions including conical facing surfaces having first recesses which are shaped as a staircase with substantially flat steps, and transformer windings disposed in said first recesses, the windings on the inner core portion and the outer core portion being situated opposite one another and cooperating in a two-by-two fashion, the windings on at least the outer core portion being constructed as self-supporting coils, characterized in that:

the facing surfaces of the core portions are constructed as double conical surfaces having bases which face one another, and the outer core portion comprises at least two parts.

2. A rotary transformer as claimed in claim 1, characterized in that the outer core portion is separated into said two parts at the area of the bases of the two conical surfaces.

3. A rotary transformer as claimed in claim 2, characterized in that the two separated parts of the outer core portion are interconnected by an annular spacer.

4. A rotary transformer as claimed in claim 3, characterized in that the annular spacer is made of an electrically conductive material.

5. A rotary transformer as claimed in claim 1, 2, 3 or 4, characterized in that each first recess in the conical surface of the outer core portion, at a side facing the base of the conical surface, merges into a second recess having a wall in the form of a cylindrical surface whose diameter is at least equal to the diameter of the surface of the outer core portion, facing the inner core portion, at the area of the transition between the first and the second recess.

6. A rotary transformer as claimed in claim 1, 2, 3 or 4, characterized in that each first recess in the conical surface of the inner core portion, at a side which is remote from the base, merges into a second recess having a wall in the form of a cylindrical surface whose diameter is at least equal to the diameter of the surface of the second core portion, facing the outer core portion, at the area of the transition between the first and the second recess.

7. A rotary transformer as claimed in claim 5, characterized in that at the side of the first recess which faces the base of the conical surface the inner core portion is includes a projection which projects into the second recess of the outer core portion and which has a wall in the form of a cylindrical surface parallel to the wall of the second recess.

8. A rotary transformer as claimed in claim 6, characterized in that at the side of the first recess which is remote from the base of the conical surface the outer core portion is includes a projection which projects into the second recess of the inner core portion and which has a wall in the form of a cylindrical surface parallel to the wall of the second recess.

* * * * *